US010477921B2

(12) United States Patent
Bode

(10) Patent No.: US 10,477,921 B2
(45) Date of Patent: Nov. 19, 2019

(54) AIR BLADDER BOOT FITTING DEVICE

(71) Applicant: Bob J. Bode, Lake Preston, SD (US)

(72) Inventor: Bob J. Bode, Lake Preston, SD (US)

( * ) Notice: Subject to any disclaimer, the term of this patent is extended or adjusted under 35 U.S.C. 154(b) by 303 days.

(21) Appl. No.: 15/427,237

(22) Filed: Feb. 8, 2017

(65) Prior Publication Data

US 2018/0220740 A1 Aug. 9, 2018

(51) Int. Cl.

| | |
|---|---|
| ***A43B 7/14*** | (2006.01) |
| ***A43B 23/02*** | (2006.01) |
| ***A43B 3/02*** | (2006.01) |
| ***A43B 7/12*** | (2006.01) |
| ***A43B 1/10*** | (2006.01) |

(52) U.S. Cl.

CPC ..... *A43B 23/029* (2013.01); *A43B 1/10* (2013.01); *A43B 3/02* (2013.01); *A43B 7/12* (2013.01)

(58) Field of Classification Search

CPC ..... A43B 23/029; A43B 23/02; A43B 1/10; A43B 7/12

USPC ..... 36/93, 117.6

See application file for complete search history.

(56) References Cited

U.S. PATENT DOCUMENTS

| | | | | |
|---|---|---|---|---|
| 5,152,083 | A | 10/1992 | Gagne | |
| 5,253,435 | A * | 10/1993 | Auger | A43B 5/00 36/114 |
| 5,329,705 | A | 7/1994 | Grim | |
| 5,868,690 | A * | 2/1999 | Eischen, Sr. | A61H 9/0078 128/DIG. 20 |
| 6,189,172 | B1 * | 2/2001 | Baek | A43B 5/0407 12/142 P |
| 6,655,050 | B1 * | 12/2003 | Lowe | A43B 5/0401 36/117.1 |
| 7,717,869 | B2 * | 5/2010 | Eischen, Sr. | A43B 23/029 601/152 |
| 8,251,932 | B2 | 8/2012 | Fout | |
| 2006/0189905 | A1 * | 8/2006 | Eischen, Sr. | A43B 23/029 601/152 |

FOREIGN PATENT DOCUMENTS

| | | |
|---|---|---|
| DE | 4104733 | 12/2005 |
| EP | 1502517 | 2/2005 |
| FR | 2542983 | 8/1991 |
| JP | 2014138635 | 7/2014 |
| WO | WO2004066770 | 8/2004 |

* cited by examiner

*Primary Examiner* — Timothy K Trieu

(57) ABSTRACT

An air bladder boot fitting device facilitates snug fitting to prevent unintended removal of a boot. The device includes a boot having a sole and an upper coupled to and extending upwardly from the sole. The upper includes a shaft section extending downwardly from an open upper edge. A bladder is coupled to the upper and positioned within an interior of the boot. The bladder extends along the shaft section for securing a foot within the boot when the bladder is inflated. A bulb valve is coupled to the bladder for inflating the bladder.

6 Claims, 5 Drawing Sheets

AIR BLADDER BOOT FITTING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to boot fitting devices and more particularly pertains to a new boot fitting device for facilitating snug fitting to prevent unintended removal of a boot.

BRIEF SUMMARY OF THE INVENTION

An embodiment of the disclosure meets the needs presented above by generally comprising a boot having a sole and an upper coupled to and extending upwardly from the sole. The upper includes a shaft section extending downwardly from an open upper edge. A bladder is coupled to the upper and positioned within an interior of the boot. The bladder extends along the shaft section for securing a foot within the boot when the bladder is inflated. A bulb valve is coupled to the bladder for inflating the bladder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
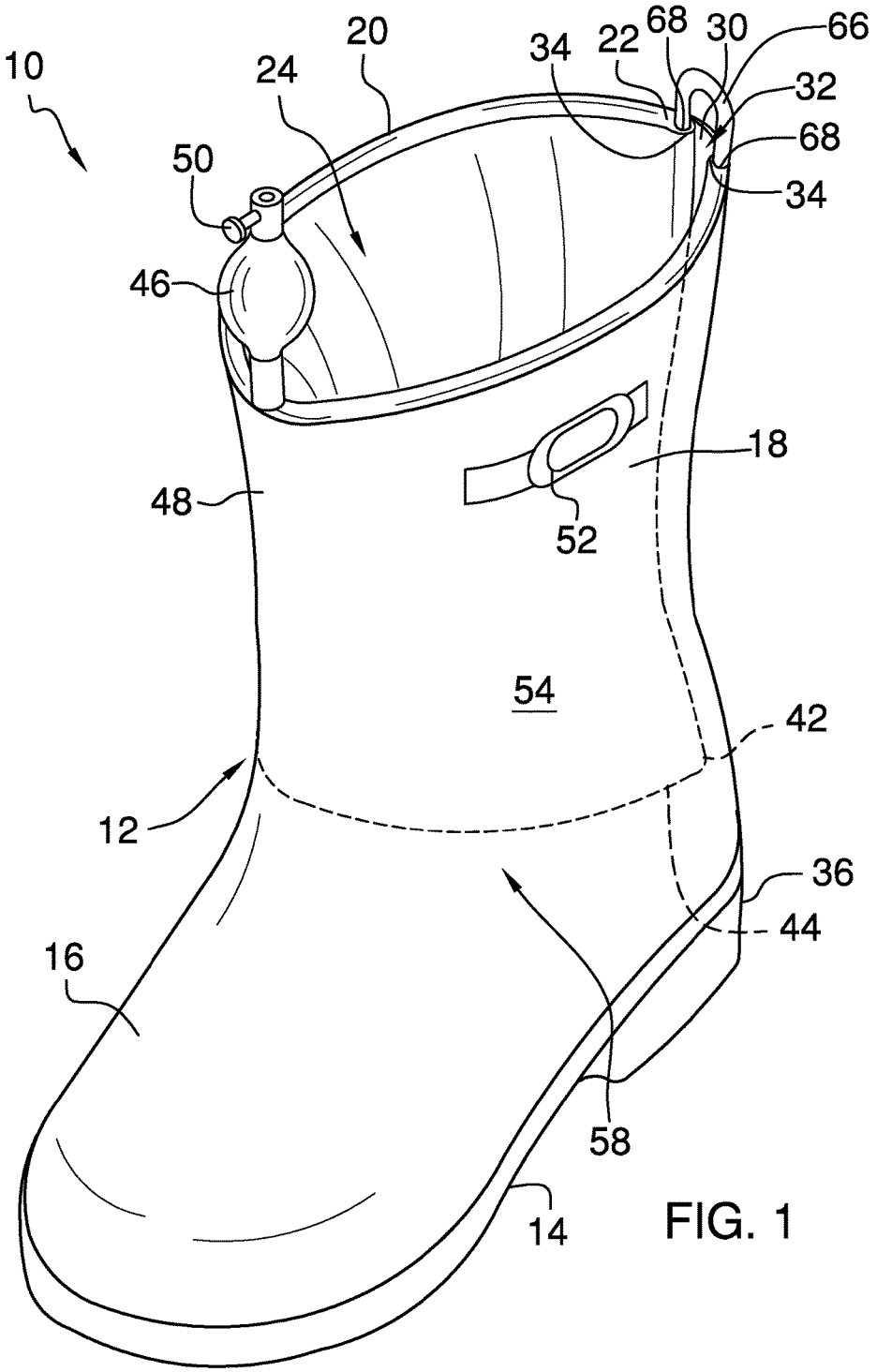
FIG. 1 is a top front side perspective view of an air bladder boot fitting device according to an embodiment of the disclosure.
Figure 2:
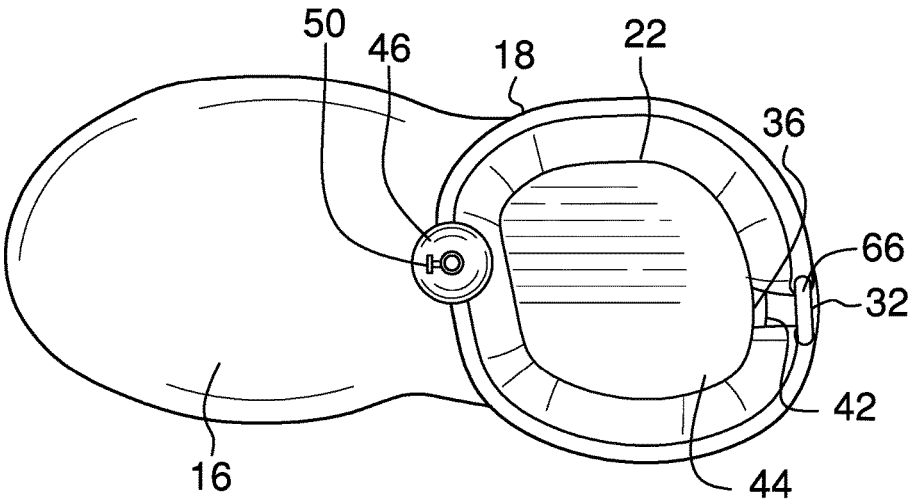
FIG. 2 is a top view of an embodiment of the disclosure.
Figure 3:
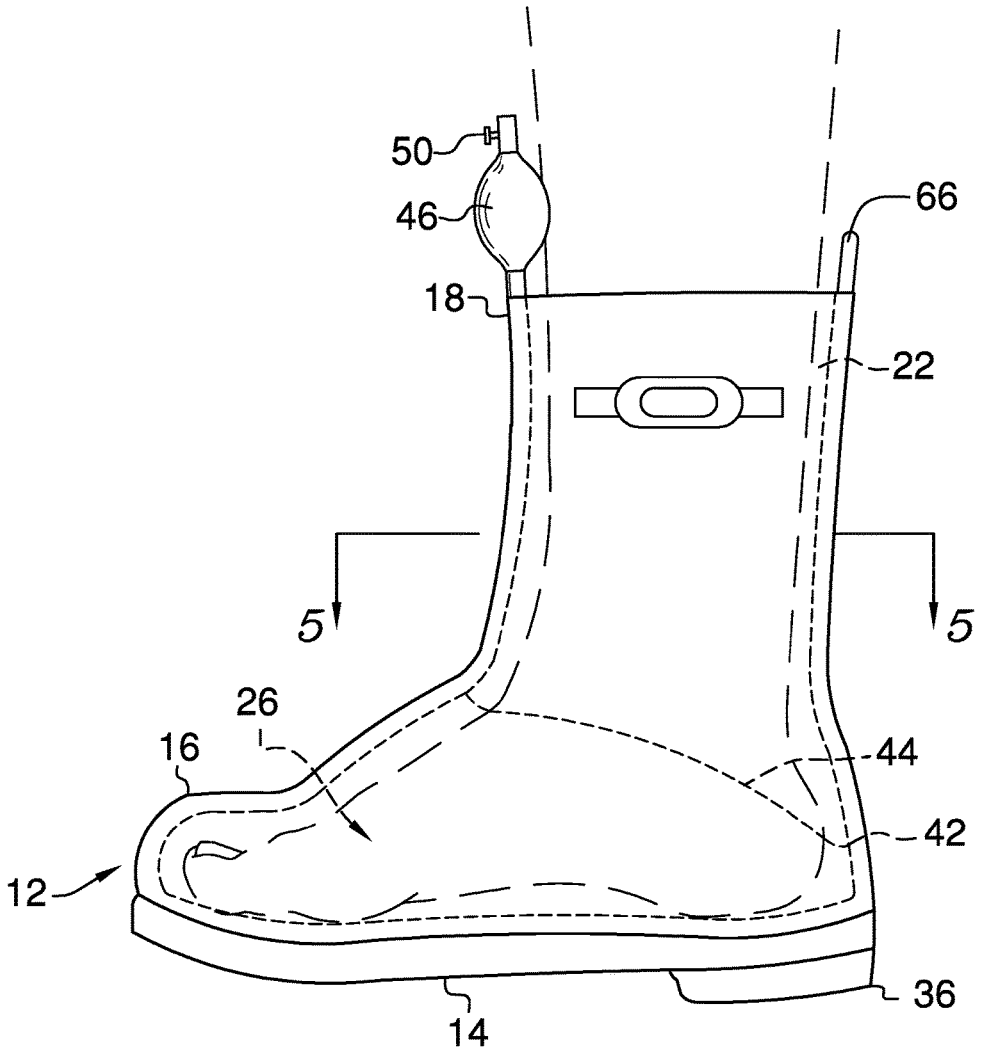
FIG. 3 is a side view of an embodiment of the disclosure.
Figure 4:
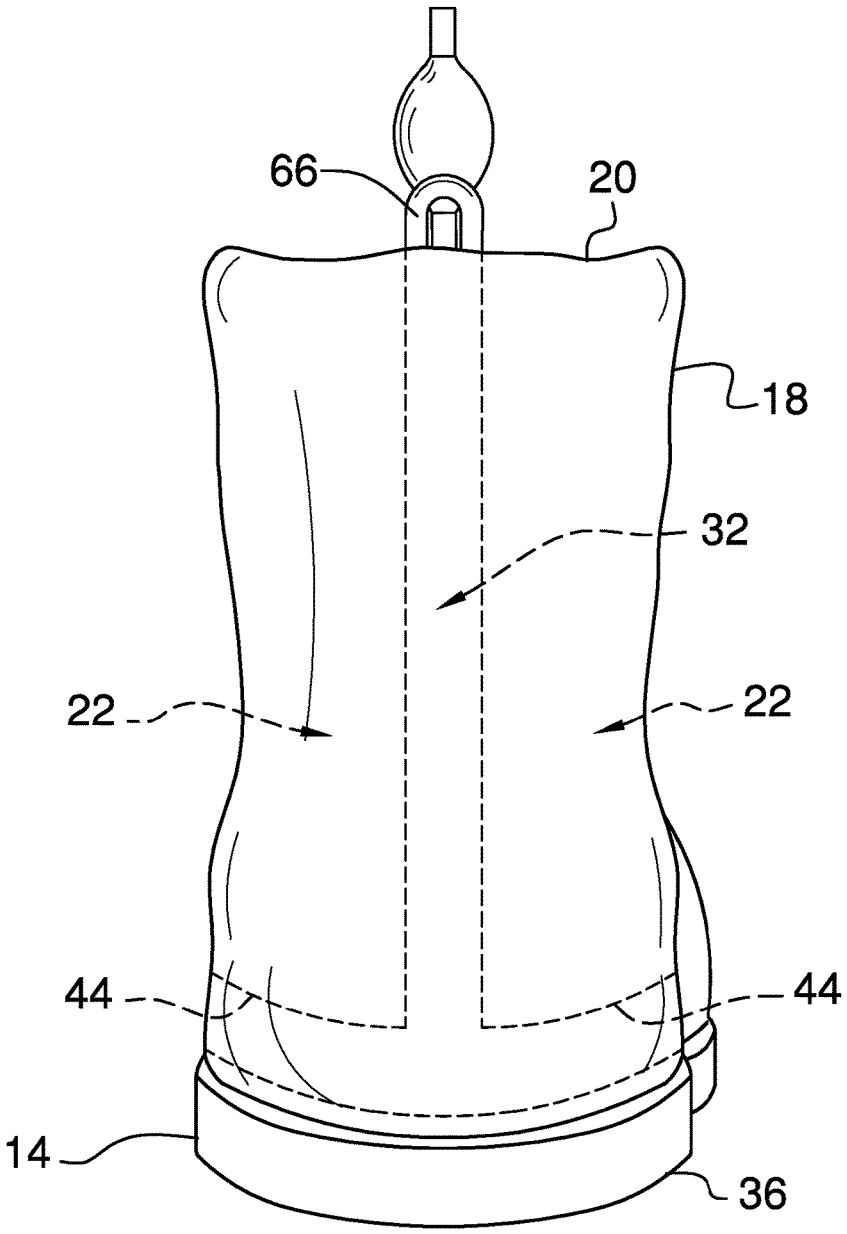
FIG. 4 is a rear view of an embodiment of the disclosure.
Figure 5:
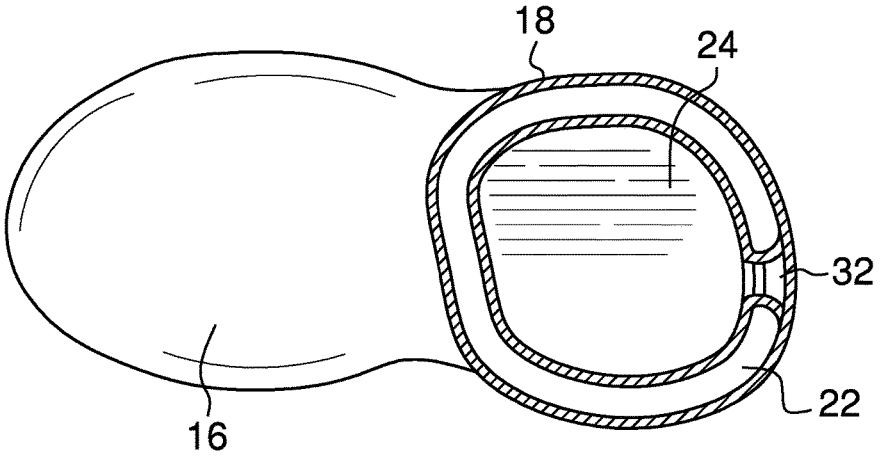
FIG. 5 is a cross-sectional view of an embodiment of the disclosure taken along line 5-5 of FIG. 3.

With reference now to the drawings, and in particular to FIGS. 1 through 5 thereof, a new boot fitting device embodying the principles and concepts of an embodiment of the disclosure and generally designated by the reference numeral 10 will be described.

As best illustrated in FIGS. 1 through 5, the air bladder boot fitting device 10 generally comprises a boot 12 having a sole 14 and an upper 16 coupled to and extending upwardly from the sole 14. The upper 16 includes a shaft section 18 extending downwardly from an open upper edge 20. A loop 66 has opposite ends 68 coupled to the open upper edge 20 or the shaft section 18 such that the loop 66 extends up from the open upper edge 20 aligned with a heel 36 of the boot 12. The boot 12 is of the type conventionally used when pouring concrete and requiring engagement to the user to prevent suction from removing the boot 12 from the user during use.

A bladder 22 is coupled to the upper 16 and positioned within an interior 24 of the boot 12. The bladder 22 is coextensive with and extends along the shaft section 18 wherein the bladder 22 is configured for securing a foot 26 within the boot 12 when the bladder 22 is inflated. The bladder 22 extends partially around a circumference of an interior surface 30 of the shaft section 18 wherein a strip 32 of the shaft section 18 is exposed within the interior 24 of the boot 12. The strip 32 is defined between opposed edges 34 of the bladder 22. The strip 32 extends upwardly between the heel 36 of the boot 12 to the open upper edge 20. A bottom end 42 of the strip 32 may extend below a bottom edge 44 of the bladder 22 under the shaft section 18 terminating between 3 and 7 centimeters above the sole 14 of the boot 12. Thus, the strip 32 generally corresponds to and aligns with the Achilles tendon and bears the friction of the user's heel as the boot 12 is put on or taken off. The strip 32 may be reinforced in a conventional manner. The loop 66 is vertically aligned with the strip 32.

A bulb valve 46 is coupled to the bladder 22 for inflating the bladder 22 by hand squeezing of the bulb valve 46. The bulb valve 46 is positioned outside of the boot 12. The bulb valve 46 is coupled to the bladder 22 aligned with a front quarter 48 of the shaft section 18 of the upper 16 and extending from the open upper edge 20. Thus, the bulb valve 46 is accessible to the user but positioned to minimize interference with tasks performed by the user such as pouring of concrete. A release valve 50 is provided in the bulb valve 46 and in fluid communication with the bladder 22 wherein the bladder 22 is deflated by opening of the release valve 50. The mechanism for operation of the release valve 50 faces away from the front quarter 48 to facilitate access to and manipulation of the release valve 50.

A latch 52 of conventional design may also be coupled to an exterior surface 54 of the boot 12 proximate the open upper edge 20 in a conventional manner for securing the shaft section 18 around a calf of the user and providing additional security against unintended removal of the boot 12 from the user. An exterior 58 of the sole 14 and the upper 16 is rubberized or otherwise sealed in a conventional manner wherein the boot 12 is waterproof and configured for use while pouring concrete.

In use, the user inserts the foot 26 into the boot 12. The bulb valve 46 is squeezed as needed to inflate the bladder 22 securing the foot 26 within the boot 12. When desired, the release valve 50 is opened to deflate the bladder 22 and allow removal of the boot 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An air bladder boot fitting device comprising: a boot having a sole, an upper coupled to and extending upwardly from said sole, said upper including a shaft section extending downwardly from an open upper edge;

a bladder coupled to said upper, said bladder being positioned within an interior of said boot, said bladder extending along said shaft section wherein said bladder is configured for securing a foot of the wearer within said boot when said bladder is inflated, said bladder extending partially around a circumference of an interior surface of said shaft section wherein a strip of said shaft section is exposed within said interior of said boot, said strip extending upwardly from a heel of said boot to said open upper edge; and a bulb valve coupled to said bladder such that said bulb valve is configured for inflating said bladder; wherein said strip is configured to correspond to and align with the achilles tendon of the user and bears the friction of the user's heel as the boot is put on or taken off.

2. The device of claim 1, further comprising said bulb valve being positioned outside of said boot, said bulb valve being coupled to said bladder aligned with a front quarter of said shaft section of said upper and extending from said open upper edge.

3. The device of claim 1, further comprising a release valve being in fluid communication with said bladder wherein said bladder is deflated by opening of said release valve.

4. The device of claim 1, further comprising a latch coupled to an exterior surface of said boot proximate said open upper edge wherein said latch is configured for securing said shaft section around a calf of the user.

5. The device of claim 1, further comprising an exterior of said sole and said upper being rubberized wherein said boot is waterproof and configured for use while pouring concrete.

6. An air bladder boot fitting device comprising:

a boot having a sole, an upper coupled to and extending upwardly from said sole, said upper including a shaft section extending downwardly from an open upper edge;

a bladder coupled to said upper, said bladder being positioned within an interior of said boot, said bladder extending along said shaft section wherein said bladder is configured for securing a foot of the user within said boot when said bladder is inflated, said bladder extending partially around a circumference of an interior surface of said shaft section wherein a strip of said shaft section is exposed within said interior of said boot, said strip extending upwardly from a heel of said boot to said open upper edge;

a bulb valve coupled to said bladder such that said bulb valve is configured for inflating said bladder, said bulb valve being positioned outside of said boot, said bulb valve being coupled to said bladder aligned with a front quarter of said shaft section of said upper and extending from said open upper edge;

a release valve being in fluid communication with said bladder wherein said bladder is deflated by opening of said release valve;

a latch coupled to an exterior surface of said boot proximate said open upper edge wherein said latch is configured for securing said shaft section around a calf of the user; and an exterior of said sole and said upper being rubberized wherein said boot is waterproof and configured for use while pouring concrete; and wherein said strip is configured to correspond to and align with the achilles tendon of the user and bears the friction of the user's heel as the boot is put on or taken off.

* * * * *